United States Patent [19]

Irvello

[11] Patent Number: 5,033,197

[45] Date of Patent: Jul. 23, 1991

[54] DRY WALL/PANEL APPLICATOR'S TOOL

[76] Inventor: Mario M. Irvello, 3808 Landis Mill Rd., Collegeville, Pa. 19426

[21] Appl. No.: 455,086

[22] Filed: Dec. 22, 1989

[51] Int. Cl.[5] ..... B43L 9/04; B43L 13/02

[52] U.S. Cl. ..... 33/42; 33/27.03

[58] Field of Search ..... 33/42, 43, 44, 427, 33/428, 452, 464, 419, 470, 27.02, 27.03, 27.031, 27.032, 32.2; 30/164.95, 287, 292, 319; 83/883, 884, 886

[56] References Cited

U.S. PATENT DOCUMENTS

| | | | |
|---|---|---|---|
| 1,740,597 | 12/1929 | Hoyer | 33/27.03 |
| 2,529,210 | 11/1950 | Butler | 33/44 |
| 2,681,507 | 6/1954 | Underwood | 33/27.03 |
| 2,818,644 | 7/1958 | Crawford | 33/42 |
| 3,174,225 | 3/1965 | Abraham | 30/292 |
| 3,286,351 | 11/1966 | McAlister | 33/42 |
| 3,439,426 | 4/1969 | Wilson | 30/164.95 |
| 4,334,360 | 6/1982 | Burns et al. | 33/42 |

FOREIGN PATENT DOCUMENTS

| | | | |
|---|---|---|---|
| 276973 | 11/1951 | Switzerland | 33/32.2 |

*Primary Examiner*—Harry N. Haroian
*Attorney, Agent, or Firm*—Frederick J. Olsson

[57] ABSTRACT

For applicators of panel board and/or dry wall, a combination tool which replaces three conventional applicator's tools, namely a T-square, a circle marker and a linear marker.

1 Claim, 4 Drawing Sheets

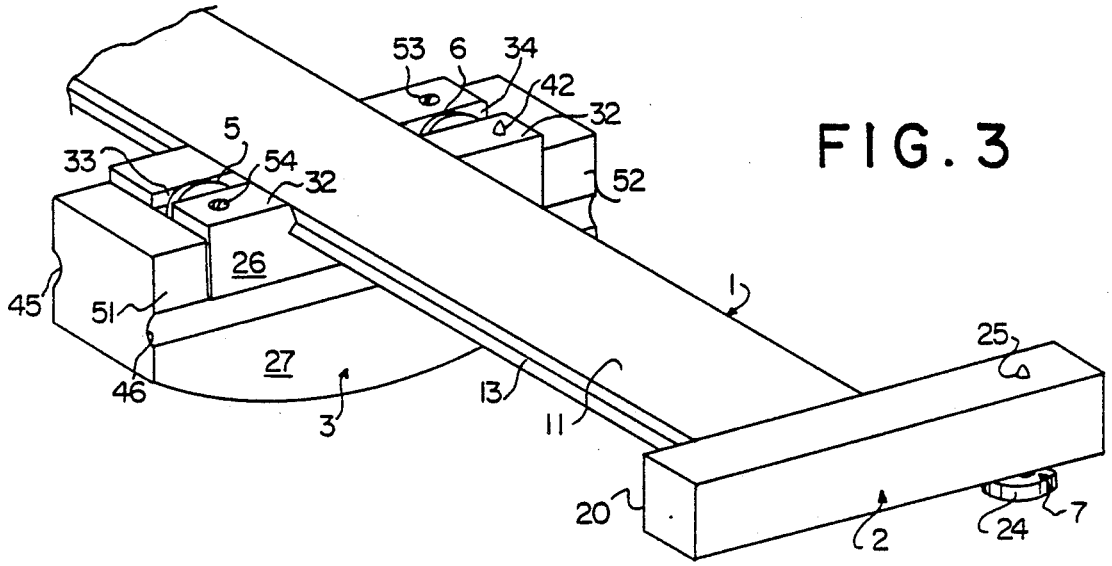
FIG. 3
FIG. 4
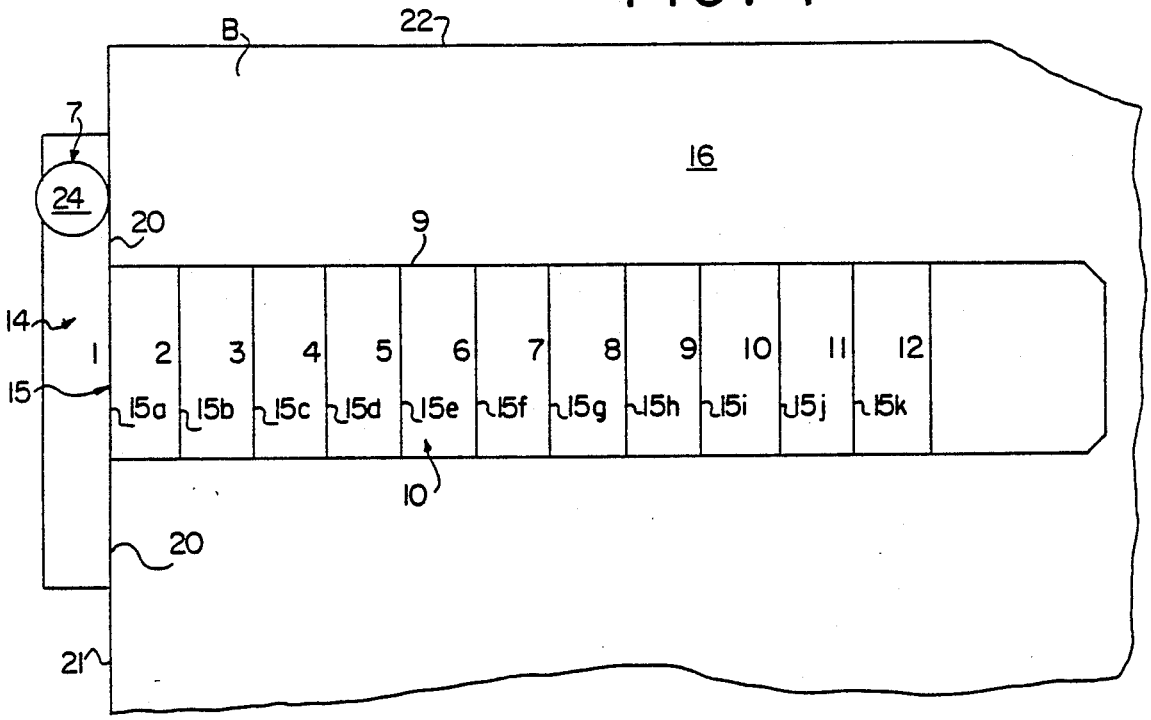

DRY WALL/PANEL APPLICATOR'S TOOL

This invention relates to building construction and repair and in particular the invention relates to tooling for use by panel and dry wall applicators.

The primary object of the invention is to provide a single tool of the kind in question which replaces three conventional tools used in panel and dry-wall applications, mainly, a T-square, a circle marker and a linear marker.

The invention will be described below in connection with the following drawings wherein FIG. 1 is a perspective view of the tool of the invention:

FIG. 3 is a perspective view, looking at the bottom side, of the tool of FIGS. 1 and 2;

FIG. 4 is a plan view of the tool of FIG. 1 when used as a T-square on dry wall;

Before proceeding with the description I want to note tool type patents that I am aware of. First, there is my Pat. Nos. 4,819,475 and those patents listed in same and second those patents set forth following: 181,663, 507,395, 852,430, 1,110,878, 2,529,210, 2,943,392, 3,286,351, 3,439,426, 3,664,025, 4,030,195, 111,579 (Great Britain).

Figure 1:
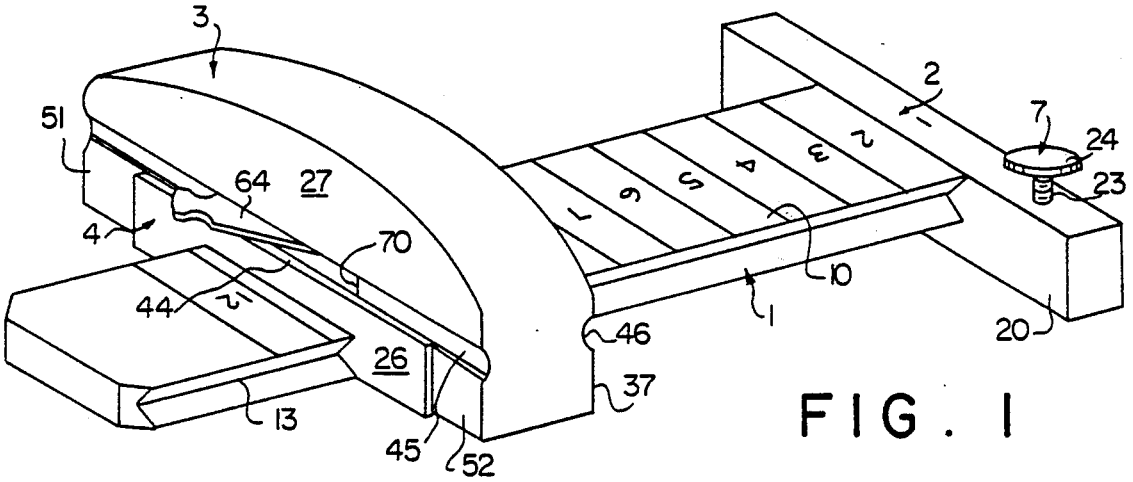
Figure 2:
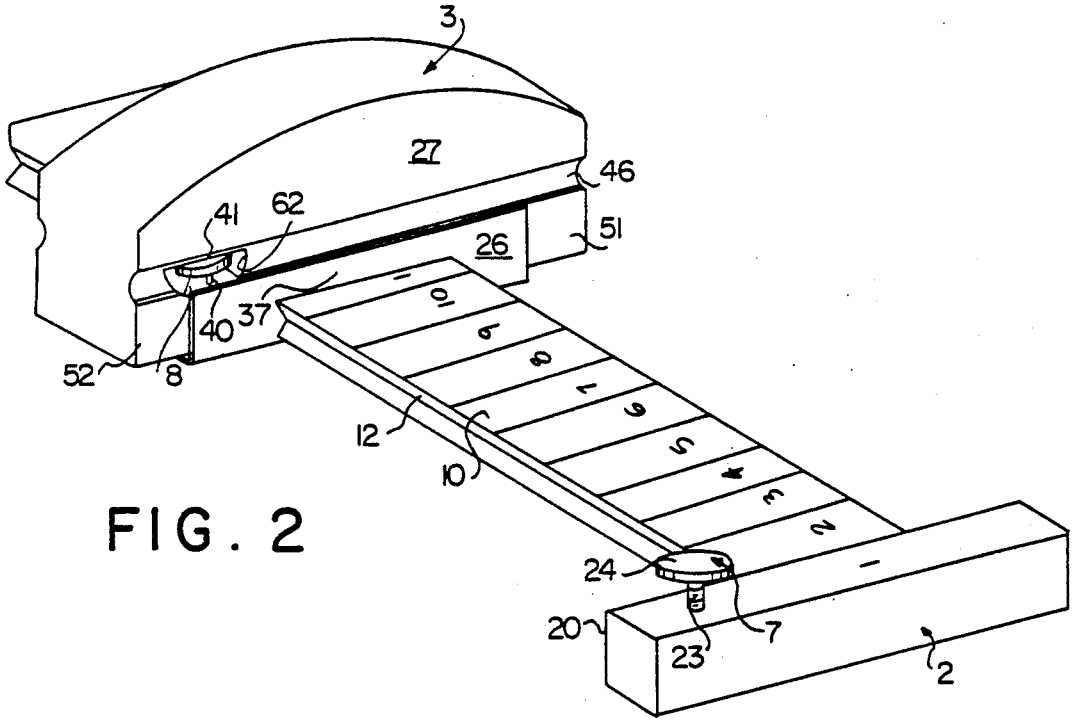
FIG. 2 is another perspective view of the tool of the invention.
Figure 5:
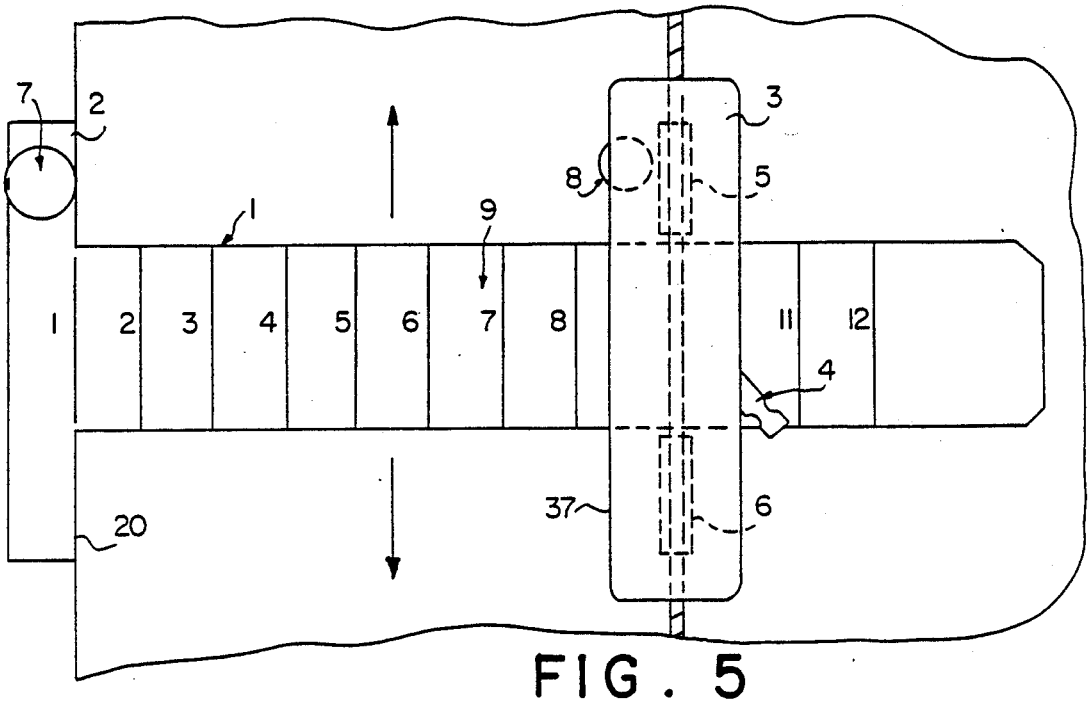
FIG. 5 is a plan view of the tool of FIG. 1 when used as a linear cutter for dry wall.
Figure 6:
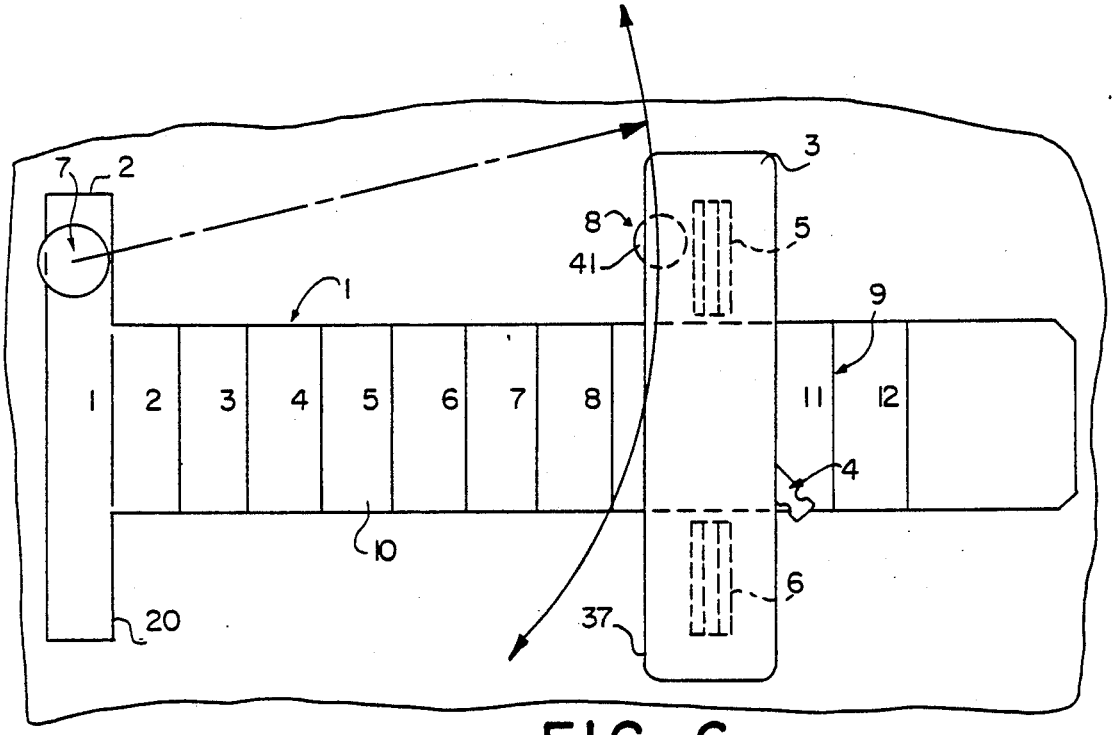
FIG. 6, is a plan view of the tool of FIG. 1 when used as a circle marker on dry wall.

Referring to FIGS. 1-3, the tool has an elongated arm 1, a head 2 connected to one end of the arm, a carrier 3 mounted on the arm for movement toward and away from the head 2, lock means 4 to lock the carrier on the arm, a pair of rotating cutters 5 and 6 (FIG. 3), and a pivot screw 7 on the head, and a scriber 8 on the carrier, and scale means 9 on the arm which is used to indicate distance with respect to the head.

Having noted the various parts of the tool I will now briefly comment on the ways the tool can be used by applicators of panel board and dry wall.

First the tool can be used as a T-square. This is done by removing the carrier 3 from the arm 1. Second, the tool (with the carrier on the arm) can be used for scribing a circle on a board, the precise center of which preferably having been obtained by employing the tool as a T-square. Lastly, the tool (with the carrier on the arm) can be used particularly on dry wall, to make a deep, precisely located cut parallel to one edge (with the unwanted piece being removed by the usual snapping and cutting).

With the above in mind I will now describe the details of the various parts of the tool.

The elongated arm 1 has a top planar surface 10 (FIG. 1 and 2), a bottom planar surface 11 (FIG. 3), and side edges which carry parallel extending track means 12 and 13. The top surface 10 carries the scale means 9 comprised of a set of numerals 14 and a set of division lines 15. The bottom surface 11 is adapted to engage the flat surface of a board. This is indicated in FIG. 4 where bottom surface 11 engages the flat surface 16 of board B.

The head 2, in plan, is generally rectangular in shape and extends outwardly on opposite sides of the arm.

The head has a datum surface 20 which extend normal to the planar bottom surface 11.

The purpose of datum surface 20 is to engage the edge of a board. Thus, as noted in FIG. 4 the datum surface 20 engages the edge 21 of board B. Another edge of the board normal to edge 21 is indicated at 22.

The pivot screw 7 has a shank 23 which is threaded and these threads mate with the thread in an aperture in the head. The axis of the shank 23 is parallel the datum surface 20 and spaced one half inch therefrom. The upper end of the shank 23 carries the knob 24, and the opposite end has a sharp point 25 (FIG. 3). The knob 24 can be rotated in one direction so that the point 25 extends outwardly away from the head as is shown in FIG. 3. Rotating of the knob in the opposite direction causes the sharp point to be recessed within the aperture in the head.

It will be understood that the length of the arm 1 may be increased and that the numerals and division lines will be accordingly increased.

I will now describe the structure of the carrier 3.

Referring to FIG. 1 and 2, the carrier has a lower part 26 and an upper part 27. The lower part 26 mounts the carrier directly on the arm 1 and the upper part 27, in turn, is mounted on the lower part 26.

Figure 7:
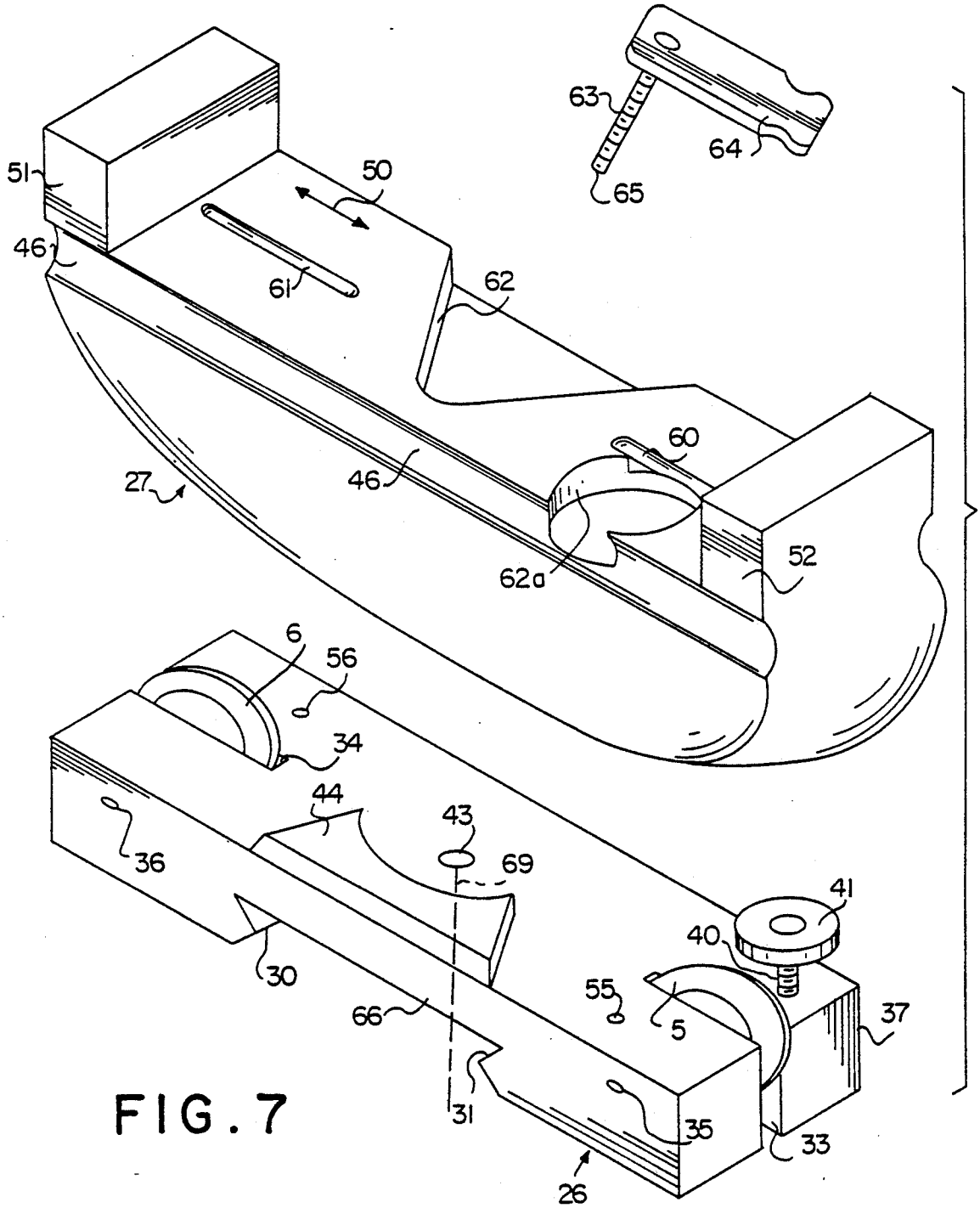
FIG. 7 is an exploded view of a carrier employed in the tool.

Referring to FIG. 7, the upper and lower parts 26 and 27 have been separated and the upper part oriented so that the underside portion which engages and envelopes the low part can be best seen. The lower part 26 in FIG. 7 is oriented the same as it is oriented in FIG. 1.

The lower part 26 is generally box-like and has centrally located track means 30 and 31 which extend across the width of the part. The track means 30 and 31 are adapted to mate respectively with the track mean 12 and 13 so as to slidingly mount the carrier on the arm.

The lower part 26 is formed with a lower surface indicated at 32 (FIG. 3) which, when the carrier is mounted on the arm, is flush with the bottom surface 11 of the arm or spaced slightly upwardly from the surface 11. Such disposition of the lower surface 32 allows the carrier to be moved back and forth when the surface 11 engages the board.

Extending inwardly from the ends of the lower part are cutter slots 33 and 34 in which are respectively disposed rotating cutters 5 and 6. The cutters 5 and 6 are mounted to lie in a plane spaced one inch from the measuring surface 37. Pivots 35 and 36 rotatably mount the cutters 5 and 6. The lower section has a measuring surface 37 (FIG. 2) for use with the division lines 15 as will be explained later.

The scriber 8 is mounted on the lower part 26. The scriber has a threaded shank 40 which mates with threads in an aperture in the lower part 26. The axis of the shank 40 is parallel to the axis of the pivot screw shank 23 and is spaced one half inch from the measuring surface 37. The upper end of the shank carries a knob 41 and the opposite and has a sharp point 42 (FIG. 3). The knob 37 can be rotated in one direction so that the point 42 extends outwardly away from the lower surface 32. Rotation of the knob in the opposite direction causes the sharp point to be recessed within the aperture on the power part 26.

Centrally located on the lower part 26 is a threaded aperture 43 which is part of the lock means 4. Adjacent the aperture 43 is a raised section 44 which likewise as part of the lock means 4. The function of aperture 43 and raised section 44 will be noted later on.

As best noted in FIG. 1 and 2 the top of the top part 27 has a contour to fit into the palm of the hand and has groves 46 and 45 for receiving the tops of the fingers. Referring back to FIG. 7 the underside of the top part 27 is cut out at 50. The cut out terminates at the overhangs 51 and 52. The cut-out 50 is dimensioned to receive the lower part 26. The upper and lower parts 26 and 27 are held together by screws 53 and 54 (FIG. 3) which extend upwardly thru apertures 55 and 56 in the lower part and ar threaded into the upper part 27.

Within the cut-out 50 are clearance slots 60 and 61, which are adapted to receive the cutters 5 and 6 when the parts are fitted together. Also, within the cut-out 50 is a cavity 62 which receives the raised section 44 and part of the lock means 4 as will be noted shortly.

Adjacent the clearance slot 60 is another cavity **62*a* which is configured to receive the knob 41. As noted in FIG. 2, the knob 41 extends outwardly the cavity 62** so that it can be rotated by engaging the flat of the thumb and pushing.

The lock means 4 functions to draw together the track means on the arm and carrier. Referring to the top of FIG. 7 a threaded stud 63 is formed with a lever 64. Before assembling the upper and lower parts 26 and 27, the stud 63 is threaded into the thread aperture 43 with the end 65 of the stud flush with the under surface 66 between the tracks 30 and 31 of the lower part 26. The surface 66 engages the top surface 10 of the arm when the carrier is mounted on the arm. The lever 64 is formed to use stick 63 so that when the end 65 is flush the lever extends along a radius indicated by the dotted line 69.

When the upper and lower part 26 and 27 are assembled, the top of the stud 63 and the lever 64 are received in the cavity 62 and the lever extends outwardly thru the clearance slot 70 (FIG. 1) formed by the raised section 44 and the top of cavity 62. In the foregoing condition, the carrier can be freely moved back and forth on the arm. When the lever is rotated clockwise to the position shown in FIG. 1 the end 65 of stud 63 moves down on the top surface 10 of the arm and causes the upper portions of the track 12 and 13 on the arm to tightly engage the upper portion of tracks 30 and 31 on the carrier. Thus, the carrier is releasably held in a desired position.

The measuring surface 37 on the carrier is used in connection with the division lines 15 to place the carrier in a desired position before the same is locked.

The relationship between the measuring surface 37 and the set 14 of numerals will now be explained.

Referring to the individual lines of the set 14, those division lines are indicated at **15*a*–15*k*. The lines are one inch apart. The set 14 has numerals 1 thru 12. These numerals indicate the distance between the cutters 5 and 6 and the datum surface 20 and also indicates the distance between the axis of the pivot shank 23 and the axis of the scriber shank 40**.

When the measuring surface 37 is on, say, the division line **15*a*, the cutters 5 and 6 are spaced one inch from the datum surface 20 and the axes of the shanks 23 and 40 are one inch apart. When the measuring surface 37 is on say division, line 15*b*, the cutters 5 and 6 are spaced two inches from the datum surface 21 and the axes of the shanks 23 and 40** are two inches apart. Shifting the carrier to the other division lines will provide corresponding separations of cutters and shanks.

With the above in mind, I will now further comment on the use of the tool.

When the tool is to be employed on a T-square the carrier 3 is removed from the arm. A typical T-square applications will be noted in connection with FIG. 4. Assume that the nearest corner of a small 2 inch square opening is to be located 6 inches from edge 21 and 6 inches from edge 22. The tool is placed as shown in FIG. 4 with the arm close to the edge 22 and marks at 6" and 8" places on the board. The tool is then pivoted 90° with the datum surface 20 on edge 22 and from the six inch and eight inch spots lines are drawn between 6" and 8". The T-square is then placed in the original position and the ends 6" and 8" lines are connected.

For use as a means to develop cut for use in breaking off a section of dry wall which is not needed (say the piece to be removed is 10"), the carrier is moved so that the measuring surface is on the numeral 10. The tool is placed on the board with the datum surface on the edge of the board. The head is held firm against the edge with one hand and the other hand presses down on the carrier so that the cutters 5 and 6 sink into the board. The carrier is then moved over the length of the board and the cutters make the desired cut on one surface. The board is turned over and a similar cut is made on the opposite side. The board is then snapped along the cut lines and the unwanted section removed For scribing a circle, the center of the circle is located by using the tool a T-square and a hole made at the center. Then the carrier is set up st that the measuring surface is at the appropriate division line for the desired radius. The knobs 24 and 41 rotated to bring the sharp points outwardly. Naturally, the knob 41 is rotated so that the sharp point is spaced outwardly of the edges of the cutters 5 and 6. The pivot point 25 is placed in the center hole. The head is held so that the point 25 remains is the hole and the carrier and arm are rotated over the board surface. With such a rotation, the point 42 marks the desired circular scribe mark.

I claim:

1. For applicators of flat panel board or flat wall board, a combination tool comprising:

an elongated arm having a planar bottom surface for engaging a planar surface on a board to be worked;

head means connected to one end of said arm, the head means having a planar datum surface which extends normal to said planar bottom surfaces, the datum surface being for use in engaging an edge of a board to be worked;

a carrier mounted on said arm and extending on opposite sides thereof, the carrier having lower surface means adjacent said planar bottom surface so as not to extend outwardly thereof;

first track means respectively disposed on opposite sides of said arm and extending therealong;

second track means on said carrier respectively engaging said first means;

said first and second track means providing for the carrier to move back and forth on said arm to any of plurality of positions;

means to releasably lock said carrier in any of said positions;

said first track means extending to the end of said arm opposite said one end whereby said carrier can be dismounted from the arm;

a scale extending along a surface of the arm and underneath said carrier, the scale including lines spaced one inch apart and a set of numerals indicating inches respectively adjacent to and for use with the lines, the line which signifies one inch being located within a plane co-planar with the datum surface;

a measuring surface on said carrier for use with said scale;

a pair of rotary cutters respectively rotatably mounted on said carrier on opposite sides of said elongated arm and extending outwardly of said lower surface means, the cutters being located in a plane normal to said planar bottom surface with said plane being located one inch from said measuring surface;

a first threaded aperture in said head means, the axis of which extends parallel said datum surface;

a pivot screw threaded in said first threaded aperture, one end of which is formed with a sharp point and the opposite end has an adjusting knob to cause rotation of the pivot screw and rotation of the pivot screw on one direction causing the sharp point to extend away from said head and rotation in the opposite direction causing said sharp point to be disposed within said first threaded aperture;

a second threaded aperture in said carrier, the axis of which extends parallel to said datum surfaces; and a marking screw threaded in said second threaded aperture, on end of which is formed with a sharp point and the opposite end has an adjusting knob to cause rotation of the marking screw, rotation of the marking screw in one direction causing the sharp point to extend away from said carrier and rotation in the opposite direction causing the sharp point to be disposed in said second threaded a aperture.

* * * * *